US006176789B1

(12) United States Patent
Kluttz et al.

(10) Patent No.: US 6,176,789 B1
(45) **Date of Patent: *Jan. 23, 2001**

(54) SCORING METHOD AND APPARATUS

(75) Inventors: James Whittle Kluttz; David Benjamin Rankin, both of Winston-Salem, NC (US)

(73) Assignee: Accu-Sport International, Inc., Winston-Salem, NC (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/010,332

(22) Filed: Jan. 21, 1998

Related U.S. Application Data

(60) Provisional application No. 60/035,673, filed on Jan. 22, 1997.

(51) Int. Cl.[7] ..... A63B 69/36
(52) U.S. Cl. ..... 473/192; 473/152
(58) Field of Search ..... 473/190, 192, 473/151, 153, 154, 155, 152

(56) References Cited

U.S. PATENT DOCUMENTS

| | | | | |
|---|---|---|---|---|
| 3,104,879 | * | 9/1963 | Jetton | 473/153 |
| 3,369,812 | * | 2/1968 | McKee | 473/192 |
| 3,413,005 | * | 11/1968 | Stearns | 473/192 |
| 3,897,947 | * | 8/1975 | Heffley, Jr. | 473/192 |
| 3,917,279 | * | 11/1975 | Barber | 473/153 |
| 4,006,907 | * | 2/1977 | Heffley, Jr. | 473/192 |
| 4,673,183 | * | 6/1987 | Trahan | 473/152 |
| 4,898,388 | | 2/1990 | Beard, III et al. | 473/192 |
| 5,029,866 | | 7/1991 | Beard, III et al. | 473/192 |
| 5,303,924 | | 4/1994 | Kluttz et al. . | |
| 5,439,224 | * | 8/1995 | Bertoncino | 473/153 |
| 5,489,099 | | 2/1996 | Rankin et al. . | |
| 5,513,841 | * | 5/1996 | Takagi | 473/154 |

FOREIGN PATENT DOCUMENTS

| | | | | |
|---|---|---|---|---|
| 490717 | * | 2/1953 | (CA) | 273/181 R |

* cited by examiner

*Primary Examiner*—Steven Wong
(74) *Attorney, Agent, or Firm*—Alston & Bird LLP

(57) ABSTRACT

The method and apparatus of the present invention scores a golf shot, such as a golf shot at a practice range, in order to provide a golfer with a meaningful index by which to measure their improvement and/or by which to compare their performance to the performance of other golfers at the practice range. The scoring method and apparatus determines the final position of the golf ball following the golf shot and generates a signal representative of the final position. The scoring method and apparatus also includes a signal processor for determining the score of the golf shot. The signal processor determines the score based upon a predetermined difficulty function and a dispersion distance between the final position of the golf ball and a predetermined target toward which the golf ball was driven. In addition, the predetermined difficulty function can be at least partially based upon a predetermined contour function which takes into account the contour or layout of a particular golf hole such that the resulting difficulty function defines contour lines of uniform difficulty surrounding the predetermined target.

19 Claims, 4 Drawing Sheets

SCORING METHOD AND APPARATUS

RELATED APPLICATION

The present application is related to and claims priority from U.S. Provisional Patent Application Serial No. 60/035,673 filed Jan. 22, 1997, the contents of which are incorporated herein in their entirety.

FIELD OF THE INVENTION

The present invention relates to a scoring method and apparatus and, more particularly, to a method and apparatus for scoring a golf shot.

BACKGROUND OF THE INVENTION

Golf ranges, both outdoor and indoor, are commonplace and serve to permit a golfer to practice a variety of shots with different clubs. While practice is required if a golfer wishes to improve their game, many golfers find practice at a golf range to be quite boring, particularly in comparison to actual play. Accordingly, Accu-Sport International, Inc. of Winston-Salem, N.C. has developed an apparatus for simulating a golf game at a practice range as described by U.S. Pat. No. 5,303,924 to James W. Kluttz, et al., the contents of which are incorporated herein in their entirety.

As described by the Kluttz '924 patent, the golf game apparatus includes a display positioned adjacent to the tee area of the practice range to display a simulated golf hole layout. Following a golf shot, the golf game apparatus determines the total distance of the shot based upon the actual flight time of the golf ball, the linear flight distance of the golf ball to an initial impact position and a simulation of the anticipated roll of the golf ball following impact. As a result, the display can also provide an indication of the final resting position of the golf ball relative to the simulated golf hole layout. The golf game apparatus of the '924 patent therefore provides a golfer with a significant amount of information regarding their practice shots, including the linear flight distance and the total distance of each shot. See also U.S. Pat. Nos. 4,898,388 and 5,029,866 to Bryce P. Beard, III, et al. which describes a system including a number of vibration sensors for determining the impact location of a golf ball and a display for providing a golfer with a visual representation of the relative position of the impact location with respect to a predetermined target. The contents of the Beard '388 and '866 patents are also incorporated herein in their entireties.

While the devices described by the Kluttz '924 patent and the Beard '388 patent represent great advances in the art, golfers must still attempt to interpret the displayed results in order to determine how well or how poorly they are hitting the golf ball. Accordingly, golfers may find it to be relatively difficult to compare the performances during different visits to the practice range or to compare their performance to the performance of another golfer at the same practice range.

SUMMARY OF THE INVENTION

The method and apparatus of the present invention scores a golf shot, such as a golf shot at a practice range, in order to provide a golfer with a meaningful index by which to measure their improvement and/or by which to compare their performance to the performance of other golfers at the practice range. The scoring method and apparatus includes means for determining the final position of the golf ball following the golf shot and for generating a signal representative of the final position. The scoring method and apparatus also includes a signal processor, responsive to the final position determining means, for determining the score of the golf shot. The signal processor determines the score based, at least in part, upon a predetermined difficulty function and a dispersion distance between the final position of the golf ball and a predetermined target toward which the golf ball was driven. Preferably, the predetermined difficulty function is at least partially based upon a target distance from the initial position of the golf ball to the predetermined target toward which the golf ball was driven, i.e., from the tee to the flag. In addition, the predetermined difficulty function can be at least partially based upon a predetermined contour function which takes into account the contour or layout of a particular golf hole such that the resulting difficulty function defines contour lines of uniform difficulty surrounding the predetermined target.

By providing a score, the method and apparatus for the present invention allows a golfer to readily compare their golf shots during different trips to the practice range. As a result, a golfer can quickly ascertain if their golf game is improving. In addition, the score provided by the method and apparatus of the present invention permits a golfer to readily compare their golf shots to the golf shots of any other golfer at the practice range. Accordingly, the scoring method and apparatus should help golfers to increase their concentration on each shot taken at a practice range in order to maximize their resulting score. In addition, the scoring method and apparatus should make practice at a practice range more enjoyable since golfers can compete either with one another or with their results from prior visits to the practice range. In addition, the score generated by the method and apparatus of the present invention can be correlated to the standard golf handicapping system, such as by the scaling means of the signal processor, in order to provide a golfer with a score in terms readily appreciated by most avid golfers.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

The method and apparatus of the present invention scores a golf shot, such as a golf shot taken at a practice range as described in more detail below. However, the method and apparatus of the present invention is a general purpose scoring system which can provide a score for a variety of activities, other than golf, in which the impact location of an object is important. For example, the scoring method and apparatus of the present invention can provide a score for darts, archery or baseball. In addition, the scoring method and apparatus of the present invention can provide a score at a firing range or a pistol range. For purposes of illustration, however, the scoring method and apparatus of the present invention will be described hereinafter in conjunction with the scoring the golf shot.

Figure 1:
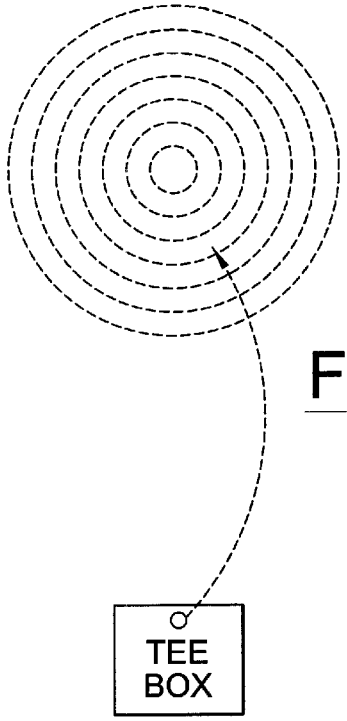
FIG. 1 is a plan view of a practice range having a tee box and a predetermined target disposed in the center of a number of concentric circles which are defined by the predetermined difficulty function associated with the target to be of uniform difficulty.
Figure 2:
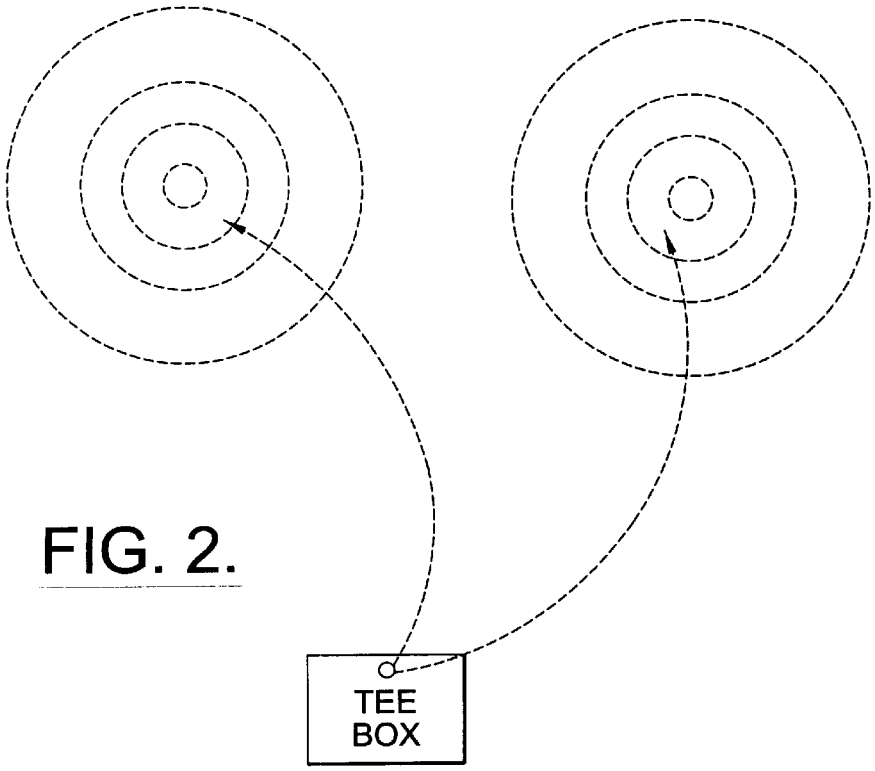
FIG. 2 is another plan view of a practice range including a tee box and two predetermined targets, each of which is centered within a number of concentric circles which are defined by the predetermined difficulty function associated with the respective target to be of uniform difficulty.

As shown in FIG. 1, a practice range is shown which includes a tee box and a predetermined target (designated X). For example, the predetermined target may be a flag located at a predetermined distance from the tee box. Alternatively, the predetermined target can include a light or other marker for designating the target toward which a golfer will drive a golf ball. As shown in FIG. 2, the practice range can include two or more targets which may be selected in either a predetermined sequence or in a random manner by either the golfer or other means, such as a computer or other controller.

Based upon the location of the target, the golfer will drive the golf ball from an initial position, typically at the tee box, to a final position, as shown by the looping arrows in FIGS. 1-4. Typically, the final position is determined by the impact location of the golf ball, that is, the first location at which the golf ball strikes the ground. However, the final position of the golf ball can instead be defined by the final resting position of the golf ball which takes into account any roll of the golf ball following its initial impact. For purposes of explanation, the final position of the golf ball will be hereinafter referred to as the impact location. It should be understood, however, that the final position of the golf ball could, instead, be defined by the final resting position of the golf ball without departing from the spirit and scope of the present invention.

Figure 5:
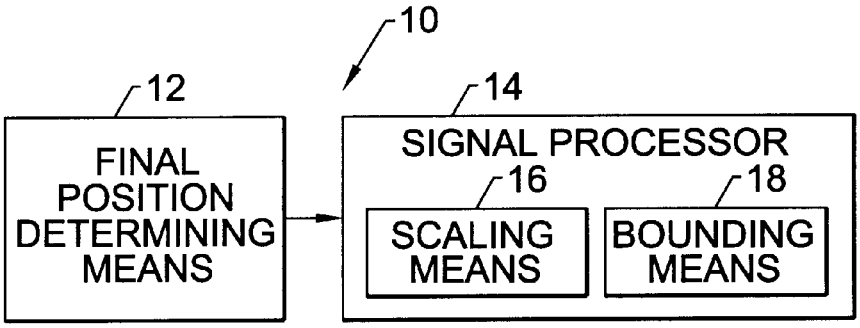
FIG. 5 is a schematic representation of an apparatus for scoring a golf shot according to one advantageous embodiment of the present invention.
Figure 6:
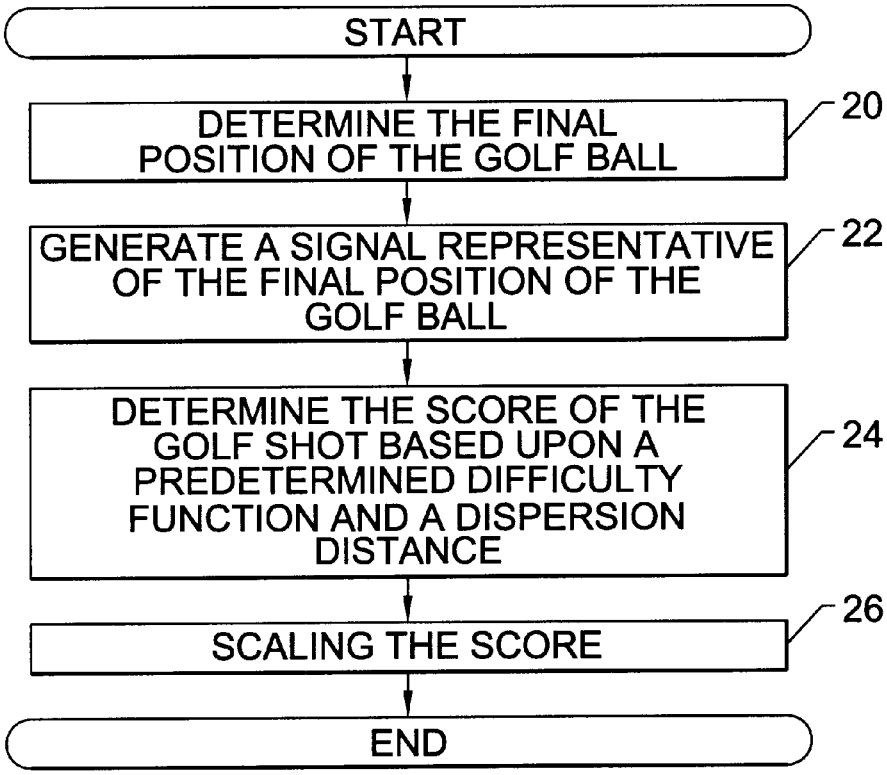
FIG. 6 is a flowchart illustrating the operations performed by the method and apparatus for scoring a golf shot according to one advantageous embodiment of the present invention.

As shown schematically in FIG. 5 and in block 20 of FIG. 6, the scoring apparatus 10 includes means 12 for determining the final position, typically the impact location, of the golf ball following the golf shot. For example, the impact location of the golf ball can be determined manually, such as by visually inspecting the impact location. Alternatively, the scoring apparatus can include at least one detector for determining the impact location of the golf ball following the golf shot. Preferably, the scoring apparatus includes a plurality of detectors positioned at various locations about the predetermined target for determining the impact location of the golf ball. While a variety of detectors can be employed to determine the impact location of the golf ball, the detectors of one advantageous embodiment include an array of acoustical sensors as described in the Kluttz '924 patent and, in more detail, in the Beard '388 and '866 patents. As described therein, the sensors are preferably positioned about the predetermined target in a triangular pattern in order to detect the impact location of the golf ball. Regardless of the manner in which the final position of the golf ball is detected, the scoring apparatus and, more particularly, the final position determining means generates a signal representative of the final position of the golf ball as shown in block 22 of FIG. 6.

The scoring apparatus 10 also includes a signal processor 14, responsive to the final position determining means 12, for determining the score of the golf shot. See block 24 of FIG. 6. The signal processor is typically comprised of a combination of software and hardware, such as a controller, for determining the score as described below. In general, the signal processor determines the score as follows:

$$\text{Score}=\text{dispersion}*\text{Penalty}(x) \quad (1)$$

wherein x is the distance between the initial position of the golf ball, such as the tee box, and the predetermined target, and wherein dispersion is the distance between the final position of the golf ball, as measured by the detectors, and the predetermined target toward which the golf ball was driven.

In one advantageous embodiment which does not take into account the contour of the land and the hazards surrounding the predetermined target, the penalty function, Penalty (x), can be defined as follows:

$$\text{Penalty}(x)=\text{Difficulty}(x). \quad (2)$$

As described below, however, the difficulty function and, in turn, the penalty function can be at least partially based upon a contour function that takes into account the contour of the land and the hazards surrounding the predetermined target.

Since the difficulty of a golf shot is dependent upon the distance of the shot, the difficulty function, Difficulty (x), of equation 2 is based, at least in part, upon the distance x between the initial position of the golf ball and the predetermined target. With respect to other sports, however, the difficulty function may be based upon other parameters, such as position angle, without departing from the spirit and scope of the present invention. The difficulty function associated with a golf shot can be illustrated by a number of imaginary contour lines of uniform difficulty surrounding the predetermined target in which the spacing of the imaginary contour lines is defined, at least in part, by the difficulty function. In instances in which no particular location of the golf ball relative to the predetermined target (right, left, long or short) is favored, for example, the difficulty function can be illustrated as number of concentric circles centered about the predetermined target as shown in dashed lines in FIGS. 1 and 2.

Since it becomes increasingly more difficult to drive a golf ball within smaller ones of the concentric circles centered about the target, the respective difficulty function associated with golf shots which impact within each of the concentric circles increases as the concentric circles becomes smaller and, correspondingly, the respective scores of the golf shots increase as the golf ball is driven within smaller ones of the concentric circles. In this regard, the penalty for missing the target can be controlled by shrinking or expanding the distance between the contour lines. For example, if the contour lines are relatively close together, more accuracy is required in order to obtain the same score than if the contour lines were spaced further apart.

As described above, the difficulty function associated with a golf shot is based at least in part upon the distance between the initial position of the golf ball and the target location. For example, the difficulty function can be defined by a linear equation as set forth below:

$$\text{Difficulty}(x)=x/25 \quad (3)$$

As will be apparent, the difficulty function described above in equation 3 defines a number of concentric circles of uniform difficulty equally spaced apart by a distance equal to x/25. See FIG. 1. As such, the score of a golf shot which lands 5 yards from a target which is 100 yards from the tee box could be determined as follows:

$$\text{Score}=5*100/25=20 \quad (4)$$

Likewise, the score of a golf shot which lands 5 yards from a target which is located 200 yards from the tee box could be determined as follows:

$$\text{Score}=5*200/25=40 \quad (5)$$

The difficulty function need not be defined by a linear equation, but can be defined, instead, by other types of equations, such as the quadratic equation set forth below:

$$\text{Difficulty}(x)=x^2/2500 \quad (6)$$

As illustrated in FIG. 2 in which the concentric circles of uniform difficulty are spaced further apart as the circles increase in size, the difficulty function set forth in equation 6 is more forgiving as the distance between the initial position of the golf ball and the target increases than the linear version of the difficulty function set forth in equation 3. In other words, the quadratic difficulty function set forth in equation 6 recognizes that a golf shot which is twice as long may be twice as hard. For example, a golf shot which lands 5 yards from a target which is 100 yards from the tee box has a score of 20 as determined below:

$$\text{Score}=5*100^2/2500=20 \quad (7)$$

Likewise, a golf shot which lands 5 yards from a target which is 200 yards from the tee box generates a score of 80 as determined below:

$$\text{Score}=5*200^2/2500=80 \quad (8)$$

As illustrated above, the quadratic difficulty function provides a much better score for the longer golf shot. As will be apparent, however, the denominator of both the linear and quadratic versions of the difficulty function can be readily varied based upon the perceived difficulty of a golf hole in order to make scoring more difficult (by increasing the denominator) or to make scoring easier (by decreasing the denominator).

As described above, difficulty functions which define, at least in part, the spacing of a number of imaginary concentric circles of uniform difficulty about the predetermined target do not favor any particular location of the golf ball relative to the target (right, left, long or short) since the signal processor 14 of this embodiment determines the score of the golf shot based only upon the distance from the initial position of the golf ball to the predetermined target and the amount of dispersion. By changing the shape of the contour lines to a non-circular shape, such as by making the contour lines either oval or elliptical, the signal processor can also weight the resulting score based upon a contour function which takes into account the relative position of the impact location of the golf shot to both the target and any hazards in the vicinity of the target.

In order to weight the resulting score based upon a contour function, the penalty function can be defined as:

$$\text{Penalty}(x)=\text{Difficulty}\ (\text{Contour}(x)) \quad (9)$$

wherein the difficulty function not only based upon the distance x from the initial position of the golf ball to the predetermined target, but is also based upon a predetermined contour function that may vary based upon the relative location of the golf ball to the target (right, left, long or short). As such, the score depends not only upon x and the dispersion, but also upon the relative location of the golf ball to the target.

As described by equations 1 and 9, for example, the score and, more particularly, the penalty function takes into account the contour function. With respect to scoring a golf shot, the contour function is primarily based upon hazards in the vicinity of the target. In any event, the contour lines defined by the difficulty function generally have a spacing that is at least partially based upon the distance x from the initial position of the golf ball to the predetermined target as described above and a shape that is typically defined by the contour function, as further described hereinbelow.

Figure 3:
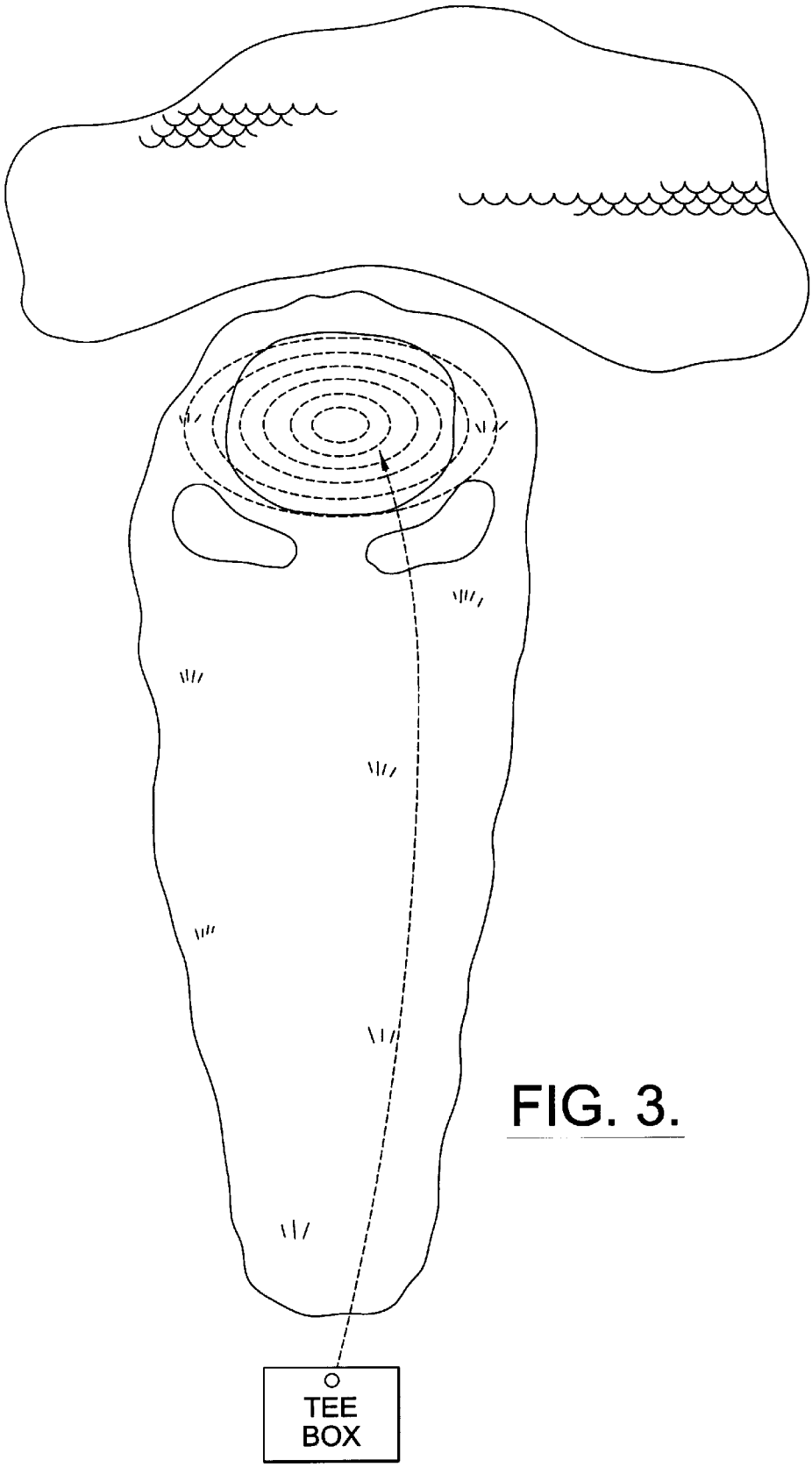
FIG. 3 is a plan view of golf hole in which the predetermined target is centered within a number of ellipses of uniform difficulty which are defined by the predetermined difficulty function which, in turn, is based upon a predetermined contour function which takes into account hazards, such as water and sand traps, located in the vicinity of the predetermined target.

As shown in FIG. 3, for example, a golf hole which includes a lake on the back side of the green and two or more sand traps on the front side of the green will generally favor distance control more than left/right control. Therefore, the contour lines (shown in dashed lines) can define a number of ovals or ellipses having a major axis extending left to right across the green. Accordingly, the predetermined difficulty function and, in turn, the predetermined contour function which define the oval or elliptical contour lines would provide a much higher score, on average, for a shot which misses the target by a predetermined distance to the right or left, than for a shot which misses the target either long or short by the same predetermined distance since the consequences of hitting the golf ball too long or too short are much more severe than the consequences of hitting the golf ball to the right or to the left of the target. Accordingly, the contour function can be employed to normalize different game situations, that is, golf shots taken on different types of golf holes, such that the resulting scores can be more readily compared.

Figure 4:
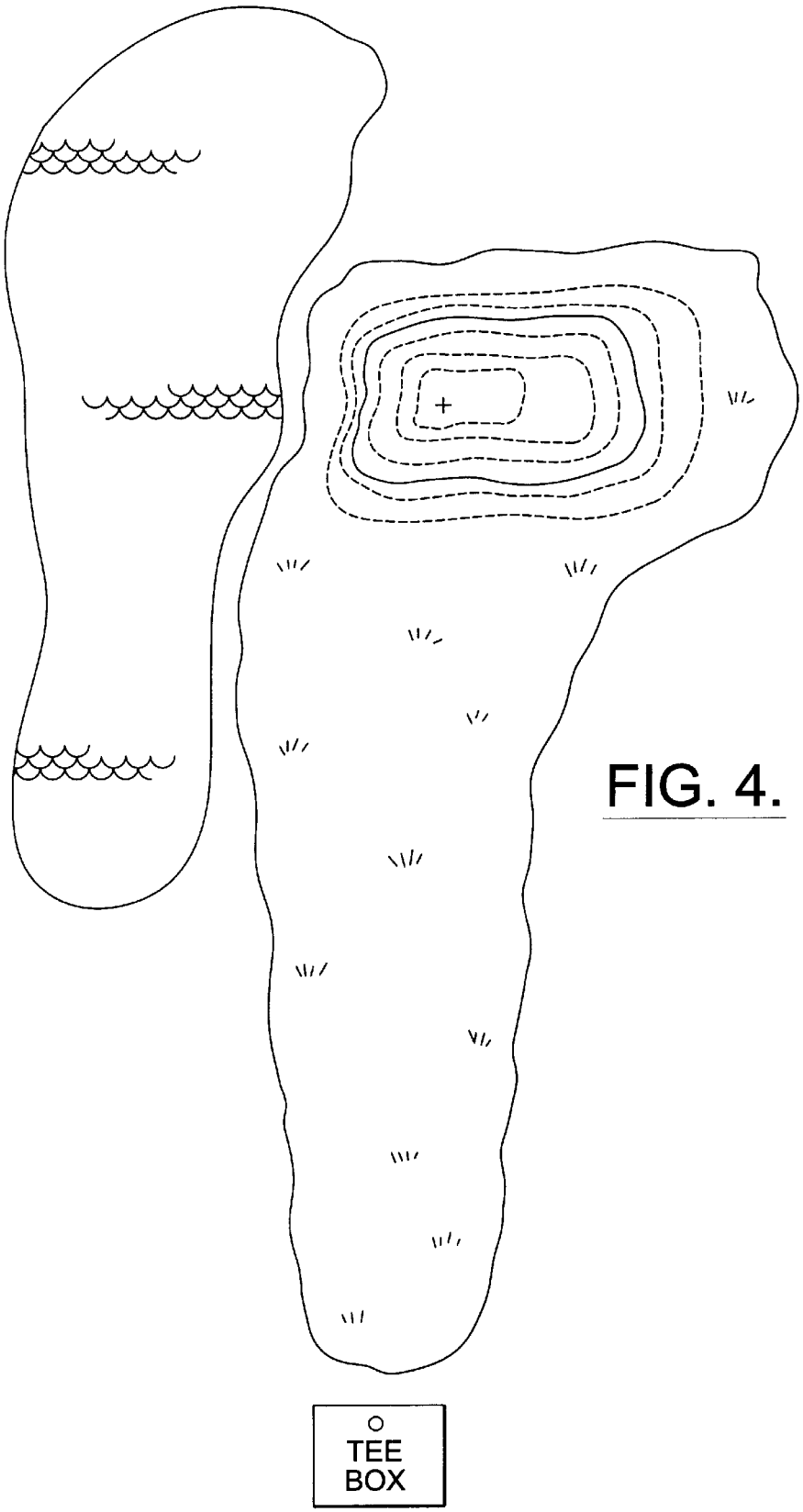
FIG. 4 is a plan view of golf hole in which the predetermined target is bordered on the left by hazards, such as a body of water, and which illustrates non-symmetrical contour lines of uniform difficulty which are spaced in an irregular manner about the target.

By way of further example, FIG. 4 illustrates a golf hole which includes a lake located very close to the left side of the green. As a result, the difficulty function and, more particularly, the contour function can define a number of contour lines which surround the target, but which are not centered about the target. As FIG. 4 therefore illustrates, the contour lines need not be symmetrical about the target and need not be evenly spaced. Instead, the contour lines can appear more like topographical lines which define irregular shapes surrounding the target in a manner dictated by the hazards in the vicinity of the target. In particular, the contour lines are generally spaced more closely in the vicinity of a hazard than in other portions of the green which are removed from the hazard. For the golf hole illustrated in FIG. 4, a golf ball which lands five feet to the right of the target will receive higher score than a golf ball which lands five feet to the left of the target since golf shots to the left of the target are much riskier.

The above examples are intended to merely illustrate certain embodiments of the scoring method and apparatus 10 and do not encompass all embodiments of the scoring method and apparatus since the scoring method and apparatus of the present invention can be implemented in a variety of other fashions as will now be apparent to those skilled in the art without departing from the spirit and scope of the present invention.

Once the signal processor 14 has determined the score, the signal processor preferably normalizes the score to a meaningful scale, such as 1 to 100. Thus, equation 1 defining score can be rewritten as follows:

$$\text{Score}=100-(\text{dispersion}*\text{Penalty}(x)) \tag{10}$$

With respect to golf, it is often advantageous to further scale the score to reflect the corresponding handicap of the golfer since golfers most commonly compare their respective games in terms of handicap. Thus, the signal processor of one advantageous embodiment can also include means 16, typically embodied by software, for scaling the score, such as described in the following example. See also block 26 of FIG. 6.

In some embodiments, the difficulty function, the contour function and/or the penalty function may be bounded in order to introduce discontinuities into the scoring method and apparatus 10 of the present invention. Thus, the signal processor 14 can include means 18, typically embodied by software, for bounding the difficulty function, the contour function and/or the penalty function as described below. By bounding the difficulty, contour and/or penalty functions, the scoring method and apparatus can deem a particular shot to be a constant score or to be unscorable. For example, some shots may be so simple that no score is allowed. Alternatively, the bounding means of the signal processor can be configured such that a golf shot into a water hazard always yields a constant score.

In one particularly advantageous application, the difficulty function is defined as follows:

$$Difficulty(x) = 2.4 * \left(\frac{350-x}{260}\right)^2 + 0.15 \tag{11}$$

in which 350 serves as an upper bound upon the distance which a golfer can drive a golf ball. For a contour function of 1 which translates to evenly spaced, concentric contour lines, the signal processor 14 can determine the score as follows:

$$Score = 100 - \left(dispersion * \left(2.4 * \left(\frac{350-x}{260}\right)^2 + 0.15\right)\right) \tag{12}$$

As a result, a golf shot which lands 5 yards away from a target which is 100 yards from the tee box yields a score of 88.2 as determined below:

$$Score = 100 - \left(5 * \left(2.4 * \left(\frac{350-100}{260}\right)^2 + 0.15\right)\right) = 88.2 \tag{13}$$

Likewise, a golf shot which lands 5 yards away from a target which is 200 yards from the tee box yields a score of 95.2 as described below:

$$Score = 100 - \left(5 * \left(2.4 * \left(\frac{350-200}{260}\right)^2 + 0.15\right)\right) = 95.2 \tag{14}$$

In this example, the score is scaled from 0 to 100 with 100 being the best score. In other embodiments, the score may be scaled from +2 to −48 with +2 being the best score. As a result, the score of 88.2, as determined in equation 13, will handicap to −3.9, while a score of 95.2, as determined by equation 14, will handicap to −0.4.

While the method and apparatus 10 of the present invention has been described in conjunction with the scoring of a golf shot toward a predetermined target, the scoring method and apparatus can also be applied in instances which no definite target exists, such as in instances which a golf ball is driven into the fairway of a relatively long golf hole. In this instance, the signal processor 14 can determine the score of the golf shot based upon the distance between the initial position of the golf ball and the impact location of the golf ball such that longer drives will have greater difficulty and, therefore, will be awarded a higher score. In addition, the signal processor can employ the contour function based upon the impact location of the golf ball, such as the fairway, the rough, the hazard or the green, and by the proximity of hazards to the impact location. Based upon the difficulty function, as determined by the distance which the golf ball is driven and the contour function, the signal processor can determine the score of the golf shot even in instances in which no definite target, such as no flag, exists. Moreover, the scoring method and apparatus of the present invention can be employed to score golf shots taken upon a computer-generated golf hole.

In the drawings and the specification, there has been set forth a preferred embodiment of the invention and, although specific terms are employed, the terms are used in a generic and descriptive sense only and not for purpose of limitation, the scope of the invention being set forth in the following claims.

That which is claimed is:

1. An apparatus for automatically scoring a golf shot in which a golf ball is driven from an initial position to a final position, the apparatus comprising:

means for determining the final position of the golf ball following the golf shot, said final position determining means comprising an array of acoustical sensors for automatically generating a signal representative of the final position of the golf ball; and a signal processor, responsive to said final position determining means, for automatically determining a numerical score of the golf shot at least partially based upon an equation that depends upon a predetermined difficulty function which defines imaginary lines of uniform difficulty surrounding the predetermined target and further based upon a dispersion distance between the final position and a predetermined target toward which the golf ball is driven.

2. An apparatus according to claim 1 wherein the predetermined difficulty function is at least partially based upon a predetermined contour function such that said signal processor also determines the score based, at least in part, upon the predetermined contour function.

3. An apparatus according to claim 1 wherein the predetermined difficulty function is at least partially based upon a target distance from the initial position of the golf ball to the predetermined target toward which the golf ball is driven such that said signal processor also determines the score based, at least in part, upon the target distance.

4. An apparatus according to claim 1 wherein said final position determining means includes any roll of the golf ball prior to determining the final position of the golf ball.

5. An apparatus according to claim 1 wherein said signal processor further comprises means for scaling the score of the golf shot.

6. An apparatus according to claim 1 wherein said signal processor further comprises means for bounding the predetermined difficulty function.

7. An apparatus for automatically scoring a golf shot in which a golf ball is driven from an initial position to a final position, the apparatus comprising:

means for determining the final position of the golf ball following the golf shot, said final position determining means comprising at least one sensor for automatically generating a signal representative of the final position of the golf ball; and a signal processor, responsive to said final position determining means, for automatically determining a numerical score of the golf shot at least partially based upon an equation that depends upon a dispersion distance between the final position and a predetermined target toward which the golf ball is driven and further depends upon a predetermined difficulty function which in turn depends upon a predetermined contour function that defines imaginary contour lines of uniform difficulty surrounding the predetermined target that can be altered in order to adjust the predetermined difficulty function without requiring any physical modifications of the predetermined target and an area surrounding the predetermined target.

8. An apparatus according to claim 7 wherein the predetermined difficulty function is at least partially based upon a predetermined contour function such that said signal processor also determines the score based, at least in part, upon the predetermined contour function.

9. An apparatus according to claim 7 wherein the predetermined difficulty function is at least partially based upon a target distance from the initial position of the golf ball to the predetermined target toward which the golf ball is driven such that said signal processor also determines the score based, at least in part, upon the target distance.

10. An apparatus according to claim 7 wherein said final position determining means includes any roll of the golf ball prior to determining the final position of the golf ball.

11. An apparatus according to claim 7 wherein said signal processor further comprises means for scaling the score of the golf shot.

12. An apparatus according to claim 7 wherein said signal processor further comprises means for bounding the predetermined difficulty function.

13. A method for automatically scoring a golf shot in which a golf ball is driven from an initial position to a final position, the method comprising the steps of:

determining the final position of the golf ball following the golf shot;

automatically generating a signal representative of the final position of the golf ball following said final position determining step; and automatically determining a numerical score of the golf shot, following said generating step, at least partially based upon an equation that depends upon a predetermined difficulty function and a dispersion distance between the final position and a predetermined target toward which the golf ball is driven, wherein the predetermined difficulty function depends upon a predetermined contour function that defines imaginary contour lines of uniform difficulty surrounding the predetermined target that can be altered in order to adjust the predetermined difficulty function without requiring any physical modifications of the predetermined target and an area surrounding the predetermined target.

14. A method according to claim 13 wherein the predetermined difficulty function is at least partially based upon a predetermined contour function such that said score determining step further comprises a step of determining the score at least partially based upon the predetermined contour function.

15. A method according to claim 14 wherein the predetermined difficulty function defines contour lines of uniform difficulty surrounding the predetermined target.

16. A method according to claim 13 further comprising a step of determining a target distance from the initial position of the golf ball to the predetermined target, wherein the predetermined difficulty function is at least partially based upon the target distance such that said score determining step further comprises a step of determining the score at least partially based upon the target distance.

17. A method according to claim 13 wherein said final position determining step comprises the step of including any roll of the golf ball prior to generating the signal representative of the final position of the golf ball.

18. A method according to claim 13 wherein said score determining step comprises the step of scaling the score of the golf shot.

19. A method according to claim 13 further comprising the step of bounding the predetermined difficulty function during said score determining step.

* * * * *